US008590848B1

(12) United States Patent
Newlen

(10) Patent No.: US 8,590,848 B1
(45) Date of Patent: Nov. 26, 2013

(54) ARM ELEVATION DEVICE FOR TREATMENT OF LYMPHEDEMA

(76) Inventor: Kim Newlen, Richmond, VA (US)

( * ) Notice: Subject to any disclaimer, the term of this patent is extended or adjusted under 35 U.S.C. 154(b) by 175 days.

(21) Appl. No.: 13/066,956

(22) Filed: Apr. 28, 2011

(51) Int. Cl.
*B68G 5/00* (2006.01)

(52) U.S. Cl.
USPC ..... 248/118; 128/845; 128/846; 128/878; 602/4; 602/20; 602/21

(58) Field of Classification Search
USPC ..... 248/118, 118.3, 346; 128/845, 846, 128/878, 892; 5/636, 646, 650; 602/4, 20, 602/21
See application file for complete search history.

(56) References Cited

U.S. PATENT DOCUMENTS 3,946,451 A * 3/1976 Spann ..... 5/650
4,270,235 A * 6/1981 Gutmann ..... 5/646
D287,641 S 1/1987 Schaefer
4,896,660 A 1/1990 Scott
5,195,705 A * 3/1993 Kline et al. ..... 248/118.3
D476,662 S * 7/2003 Knieper ..... D14/460
6,691,353 B2 2/2004 Fuhriman
7,017,215 B1 3/2006 Singer et al.
7,254,852 B2 * 8/2007 Martin ..... 5/636
8,043,241 B2 * 10/2011 Goumas ..... 602/4
8,122,888 B2 * 2/2012 O'Connor et al. ..... 128/845

* cited by examiner

*Primary Examiner* — Todd M. Epps

(57) ABSTRACT

An arm elevation device for lymphedema patients suffering from upper limb swelling. The arm elevation device includes a first and a second base, either of which can be selected by the user for elevating the arm in the proper manner depending on the position of the user's body. A top channel includes a concave and arcuate surface for accommodating the arm of a user. The top channel is straight in order to maintain the arm in a straight orientation and without any bends at the elbow and with minimal bending at the armpit. The arm elevation device includes a foam core surrounded by a fabric cover.

15 Claims, 5 Drawing Sheets

ARM ELEVATION DEVICE FOR TREATMENT OF LYMPHEDEMA

FIELD OF THE INVENTION

The present invention relates to health improvement devices and particularly to a therapy device for treating a person suffering from lymphedema.

BACKGROUND OF THE INVENTION

Lymphedema is a condition of localized fluid retention and tissue swelling caused by a compromised lymphatic system. Lymphedema occurs when an excess of lymph, a fluid consisting of disease and infection fighting white blood cells along with excess fluid and proteins, accumulates in an area of the body, such as an arm or a leg. The condition can be noticed by a swollen arm or leg.

Lymphedema is frequently experienced after lymph node dissection, surgery, or radiation therapy, in which damage to the lymph system is caused during the treatment of cancer. One common cause of lymphedema in women is breast cancer treatment. Lymphedema is prevalent in the upper limbs after breast cancer surgery or lymph node dissection. The condition is characterized by a swelling in the arm on the side of the body in which the surgery is performed. The swelling is caused by a compromised lymphatic system in which the lymph fluid is not recirculated back to the bloodstream and then back to the body's tissues as it should be. As fluids within the arm tend to flow downward through the limb, swelling of the arm can be exacerbated by the body position of the affected person. For many lymphedema patients, extended periods of many mundane activities, such as simply lying down or sitting, can cause fluid buildup within the arm and thus swelling.

One of the common therapies to reduce lymphedema induced swelling is elevation of the affected limb. In the case of a swollen arm, raising the affected arm above the height of the body will frequently assist the flow of lymph back into the bloodstream and will result in reducing the swelling of the arm.

Although some devices have been proposed for raising the arm in order to reduce lymphedema induced swelling, they typically suffer deficiencies. Some proposed devices for example require a patient to bend their arm at the elbow, which is not ideal as this tends to constrict the flow of lymph through the arm. Other devices provide a solution for elevating the arm while lying down but do not offer a means of elevating the arm while sitting. A person suffering from lymphedema in an arm can find the sitting posture especially hard to deal with, for example, when driving a car on a long trip.

Thus there is a need for an improved device for elevating an arm in order to assist in efficiently draining the lymph fluid back to the bloodstream. The arm elevation device of the present invention provides a comfortable means of keeping the arm of a lymphedema sufferer elevated either while sitting or lying down. The arm elevation device while in use provided unexpected beneficial results in reducing swelling of the arm by minimizing the amount of bending or crooking of the affected arm at either the elbow or the armpit.

SUMMARY OF THE INVENTION

According to the present invention, there is provided an arm elevation device for lymphedema patients suffering from upper limb swelling. The arm elevation device includes a first and a second base, either of which can be selected by the user for elevating the arm in the proper manner depending on the position of the user's body. A top channel includes a concave and arcuate surface for accommodating the arm of a user. The top channel is straight in order to maintain the arm in a straight orientation and without any bends at the elbow and with minimal bending at the armpit. The arm elevation device includes a foam core surrounded by a fabric cover.

OBJECTS AND ADVANTAGES

Several advantages are achieved with the arm elevation device of the present invention, including:

(1) The arm elevation device provides a means of elevating an arm swollen by lymphedema in order to assist gravity in removing lymph from the arm.

(2) The arm elevation device of the present invention includes a straight arm channel for maintaining the arm in a straight orientation with minimal bends at the elbow and shoulder to ease flow of lymph through capillaries in the circulatory system in those areas.

(3) The arm elevation device includes two base surfaces for anchoring the device, either of which can be selected by the user for elevating the arm in the proper manner depending on the position of the user's body.

(4) There is no break in the arm while the invention is in use, thereby maintaining circulation in the arm and assisting in the recirculation of lymph back to the bloodstream.

(5) The elbow is maintained above the heart thereby assisting gravity in draining lymph fluid from the arm.

(6) The arm elevation device can be used for assisting draining of fluids from the arm in either of two modes, including in a lying down position or in a sitting position.

(7) Since it maintains the arm at a gentle yet effective angle, the arm elevation device can be used over long time periods such as when driving a car.

(8) The arm elevation device is lightweight and portable.

(9) The arm elevation device includes a handle for easy carrying.

(10) The arm elevation device includes a removable cover which can be removed for periodic cleaning.

(11) The arm elevation device can be used in a car, either while driving or as a passenger.

These and other objects and advantages of the present invention will be better understood by reading the following description along with reference to the drawings.

TABLE OF NOMENCLATURE

Figure 1:
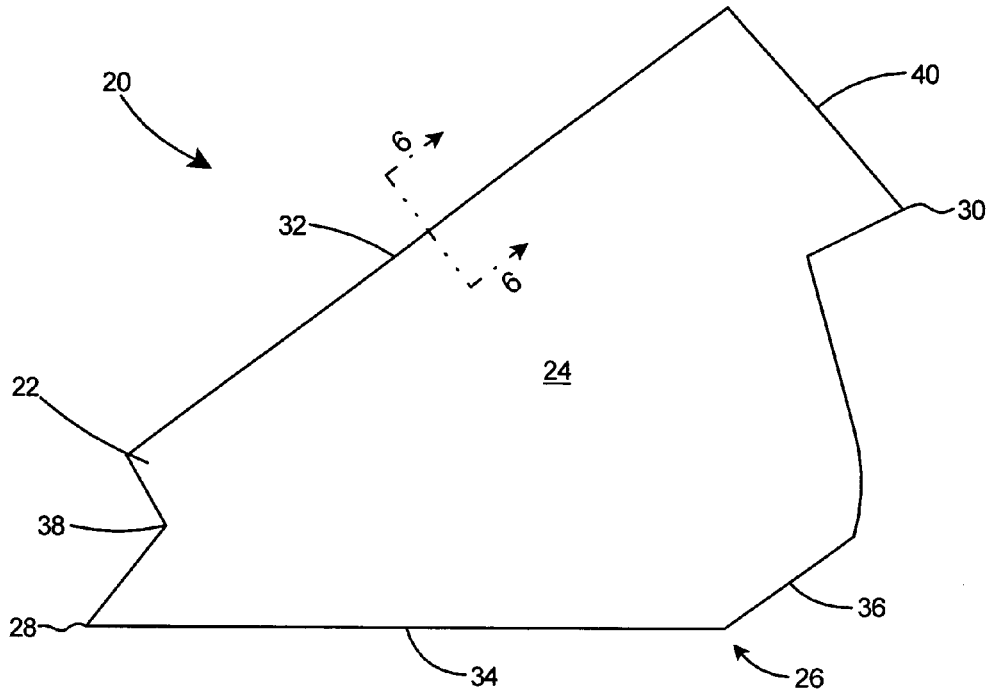
FIG. 1 is a side view of a preferred embodiment of the arm elevation device of the present invention.

The following is a listing of part numbers used in the drawings along with a brief description:

| Part Number | Description |
|---|---|
| 20 | arm elevation device |
| 22 | arm support body |
| 24 | side |
| 26 | bottom |
| 28 | first end |
| 30 | second end |
| 32 | top |
| 34 | first base |
| 36 | second base |
| 38 | shoulder support notch |
| 40 | head portion |
| 42 | flat surface of first base |
| 44 | flat surface of second base |
| 46 | axially aligned longitudinal channel or arm channel |
| 48 | axis |
| 50 | arcuate arm rest surface |
| 52 | core member |
| 54 | flexible cover |
| 55 | dots |
| 56 | channel rim |
| 57 | ribbon |
| 58 | middle of arcuate arm rest surface |
| 59 | bow |
| 60 | handle |
| 62 | closure device |
| 64 | flap |
| Θ1 | angle of arcuate surface of channel with respect to first base |
| D1 | depth from middle of arcuate arm rest surface to channel rims |
| L1 | length of first base |
| L2 | length of second base |

DETAILED DESCRIPTION

Figure 3:
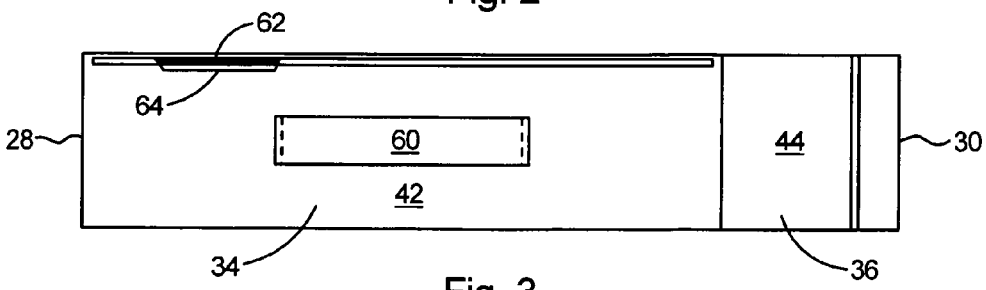
FIG. 3 is a bottom view of the arm elevation device of FIG. 1.

With reference to FIG. 1 there is shown a first and preferred embodiment of an arm elevation device 20 according to the present invention. The arm elevation device 20 includes an arm support body 22 including two sides 24, a bottom 26, a first end 28 and a second end 30. The arm support body 22 includes a top 32 that inclines at a constant slope from the first end 28 to the second end 30. The bottom 26 of the arm support body 22 includes a first base 34 and a second base 36, with the first base 34 being substantially longer than the second base 36. The arm elevation device 20 further includes a V-shaped shoulder support notch 38 at the first end 28 and a head portion 40 extending from the second end 30 adjacent the top 32 of the arm support body 22. As shown in FIG. 3, the first base 34 includes flat surface 42 and second base 36 includes flat surface 44.

Figure 2:
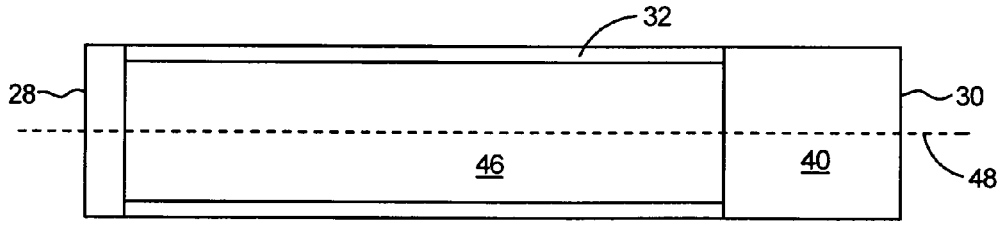
FIG. 2 is a top view of the arm elevation device of FIG. 1.
Figure 4:
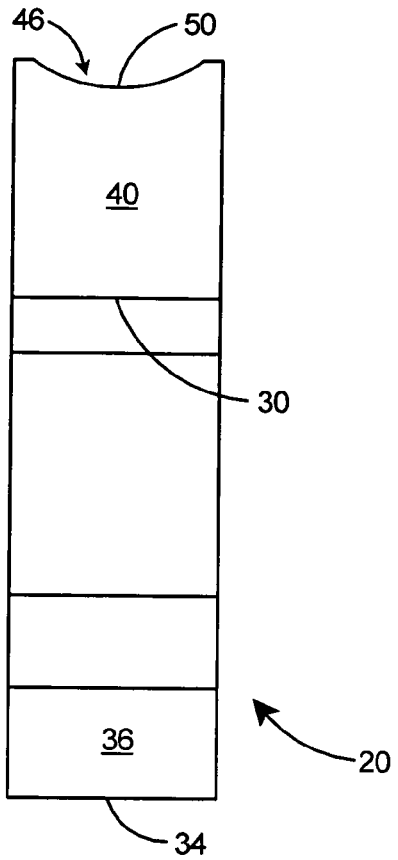
FIG. 4 is an end view of the arm elevation device as taken from the right side of FIG. 1.
Figure 5:
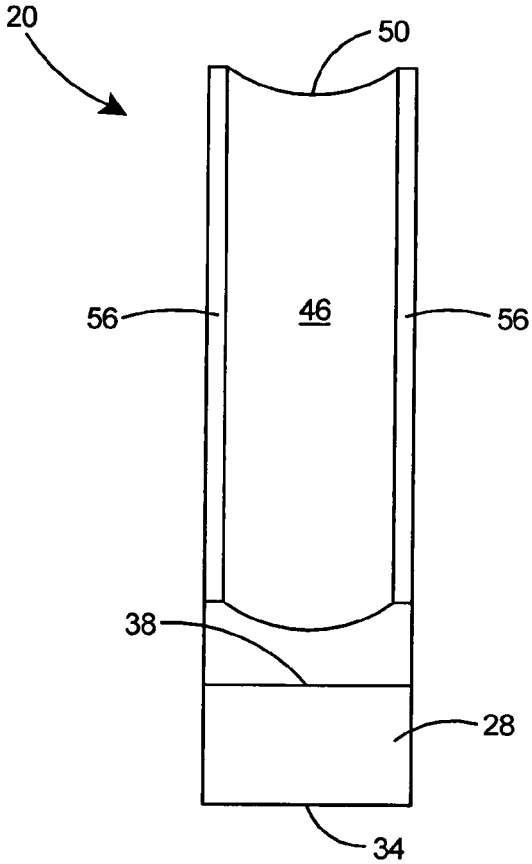
FIG. 5 is an end view of the arm elevation device as taken from the left side of FIG. 1.
Figure 6:
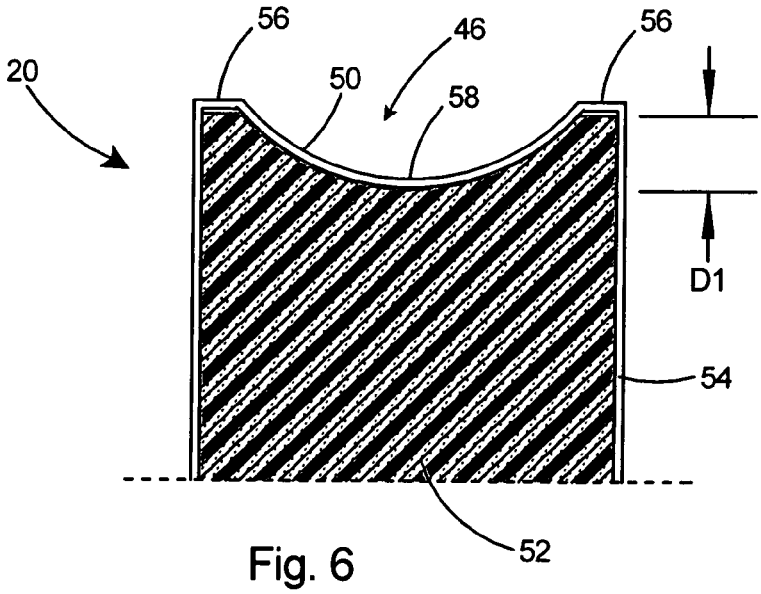
FIG. 6 is a sectional view of the arm elevation device taken along line 6-6 of FIG. 1.
Figure 7:
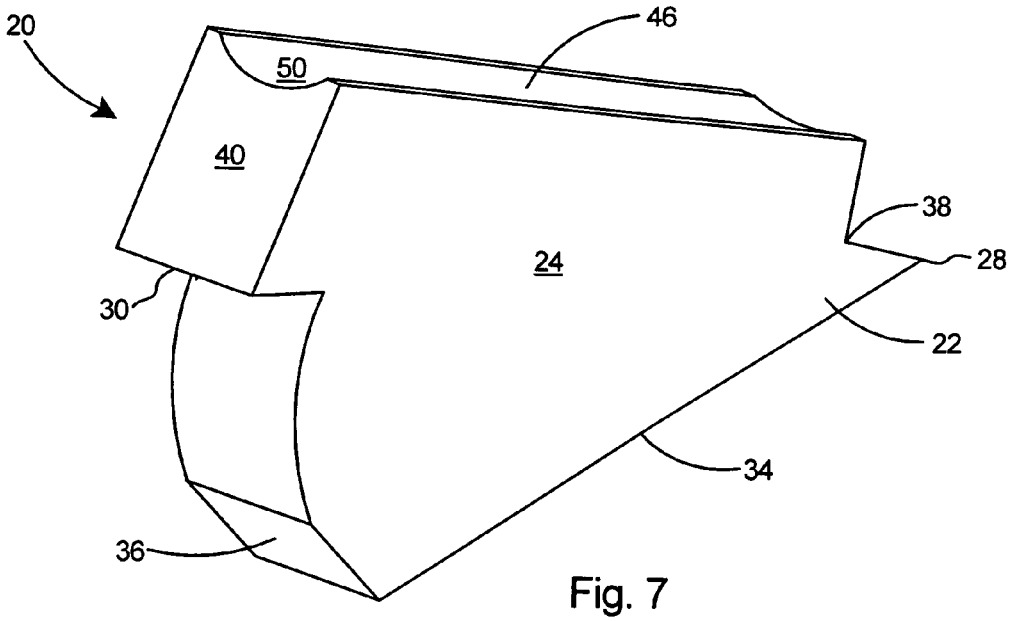
FIG. 7 is a perspective view of the arm elevation device as viewed from the right side of FIG. 1.

Referring to FIG. 2, the top 32 of the arm support body 22 includes an axially aligned longitudinal channel 46. For reasons that will be explained hereinafter, longitudinal channel 46 is straight as shown by axis 48 bisecting the channel 46. As shown in FIGS. 4-6, longitudinal channel 46 in the top 32 of the arm support body 22 includes an arcuate arm rest surface 50.

With reference to the sectional view in FIG. 6, the arm support body 22 of the arm elevation device 20 of the present invention preferably includes a core member 52 and a flexible cover 54. The arm elevation device 20 further includes a linear channel rim 56 on each side of the axially aligned longitudinal channel 46. The arcuate arm rest surface 50 preferably includes a middle 58 and the channel 46 includes a depth D1 of at least 1.0 inch from the middle 58 of the arcuate arm rest surface 50 to the channel rims 56.

Figure 9:
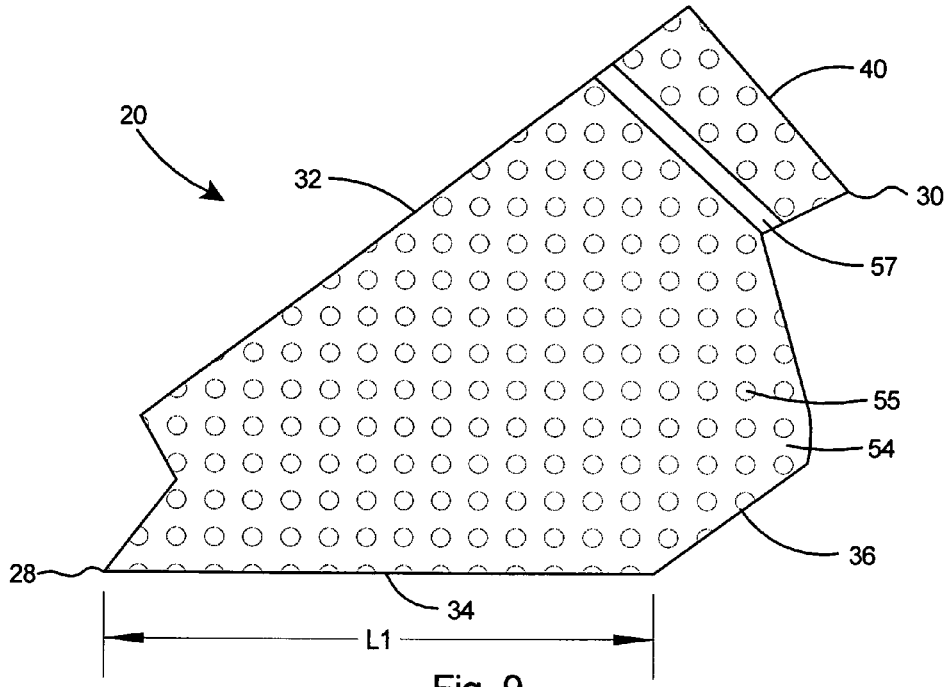
FIG. 9 is a side view of the arm elevation device resting on the first base for use by a patient in a lying position.
Figure 10:
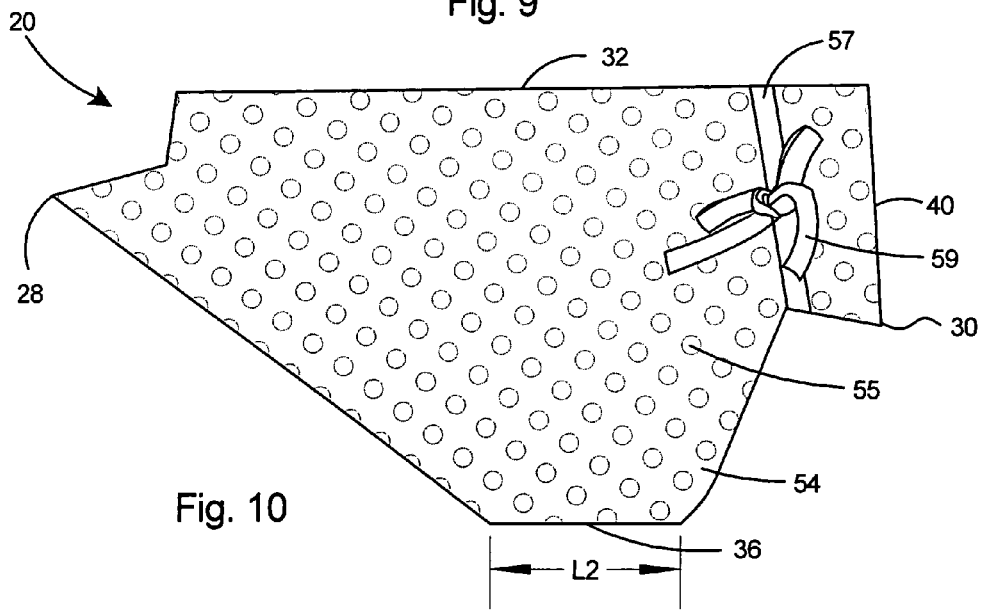
FIG. 10 is a side view of the arm elevation device resting on the second base for use by a patient in a sitting position.
Figure 11:
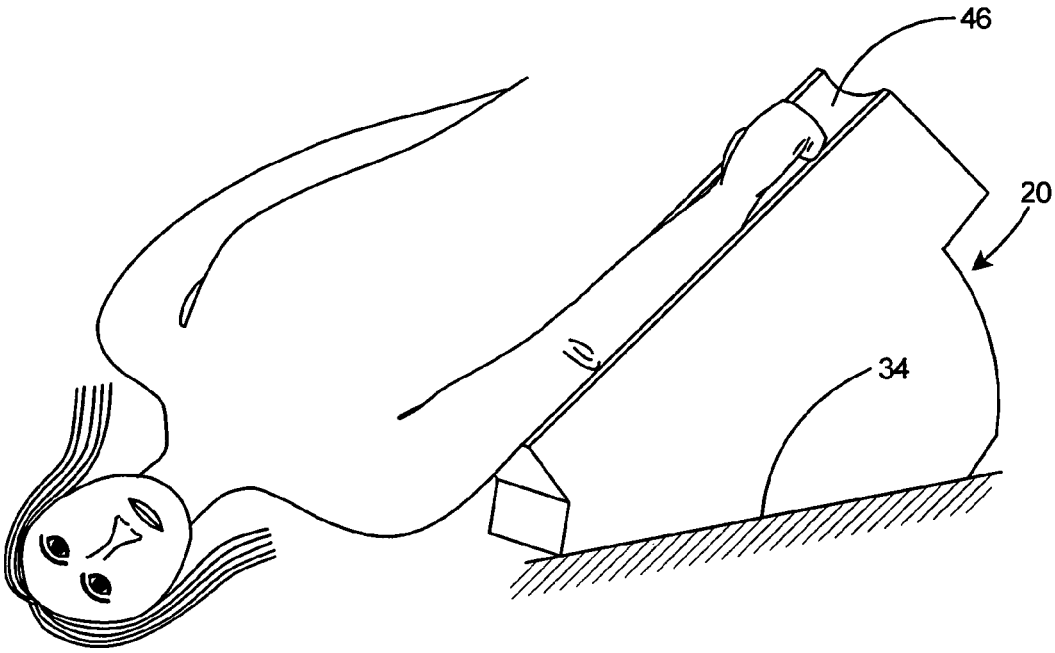
FIG. 11 is a perspective view of the arm elevation device being used by a patient in the lying position.
Figure 12:
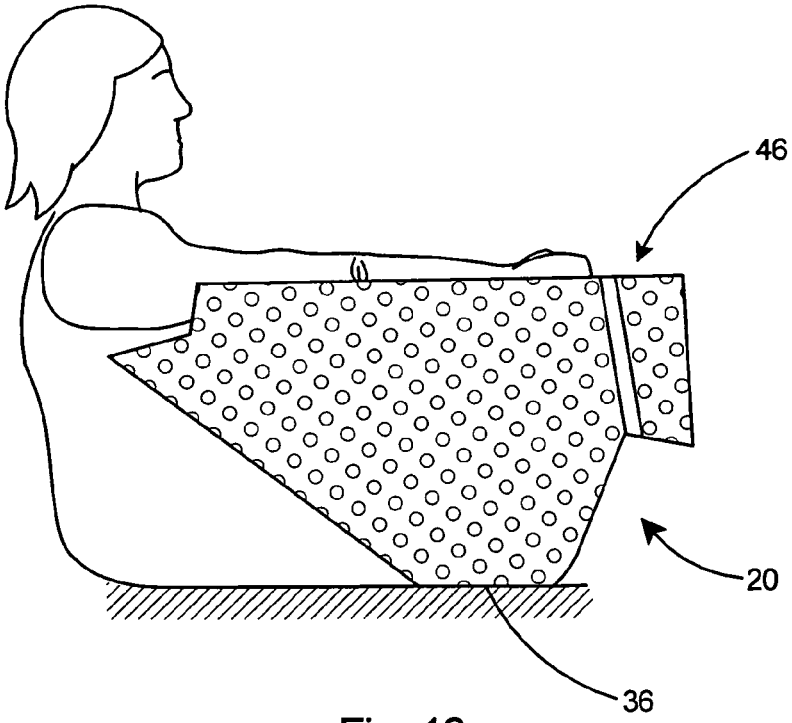
FIG. 12 is a side view of the arm elevation device being used by a patient in the sitting position.

Referring to FIGS. 9 and 10, the first base 34 and second base 36 enable the arm elevation device 20 to be operated in two different modes in order to provide a therapy device for treating a person suffering from lymphedema. The flexible cover 54 of the arm elevation device 20 may include a pattern, such as the dots 55 shown in FIGS. 9 and 10, and may further include decorative accoutrements such as a ribbon 57 at the base of the head portion 40 of the arm elevation device 20 and a bow 59 tied in the ribbon 57 as shown in FIG. 10. The dots 55, ribbon 57, and bow 59 are not functional elements of the invention but rather are decorative features added to improve the aesthetics of the arm elevation device 20. FIG. 9 depicts the arm elevation device 20 oriented with the first base 34 resting on a support surface. This orientation would be used by a person in a lying position. FIG. 10 depicts the arm elevation device 20 oriented with the second base 36 resting on a support surface, which orientation would be used by a person in a sitting position. These two positions are illustrated in FIGS. 11 and 12 respectively. The arm elevation device 20 provides a straight arm channel 46 for maintaining the arm in a straight orientation with minimal bends at the elbow and shoulder to ease the flow of lymph through capillaries in the circulatory system and thus drain the lymph fluid back to the bloodstream where it can be reabsorbed by the body. The arm elevation device 20, in both orientations, advantageously maintains the arm above the level of the user's heart, thereby assisting in gravity flow of the lymph fluid back to the blood recirculation system. The arm channel 46 maintains the arm in a straight orientation with no bends at the elbow or shoulder, thereby easing flow of lymph fluid through capillaries in the circulatory system in those areas.

With reference to FIG. 3, the arm elevation device 20 further includes a handle 60 on the first base 34. The handle 60 is positioned on the first base 34 such that the weight of the arm support body 22 is balanced when the arm support body is lifted by the handle 60. The flexible cover 54 preferably includes a closure device 62 on the first base 34 at the bottom 26 of the arm support body 22. Preferably the closure device is a zipper, snaps, or a hook and loop fastener. Hook and loop fasteners are known by trade name VELCRO® brand fasteners and are available from commercial vendors such as Industrial Webbing Corporation in Boynton Beach, Fla. The flexible cover 54 of the arm elevation device 20 further includes a flap 64 there over the closure device 62. A portion of the flap 64 is pulled back in FIG. 3*to* show the closure device 62.

The core member is preferably constructed of foam material. Most preferably the foam material is polyurethane foam. The polyurethane foam includes a density of from 0.90 to 1.10 pounds per cubic foot measured according to ASTM 3574 and an indentation force deflection at 25% deflection of from 27 to 33 pounds measured according to ASTM 3574. The foam core member 52 must be stiff enough to maintain its shape during use but also soft enough to provide a comfortable arcuate arm rest channel 50 for the user.

Figure 8:
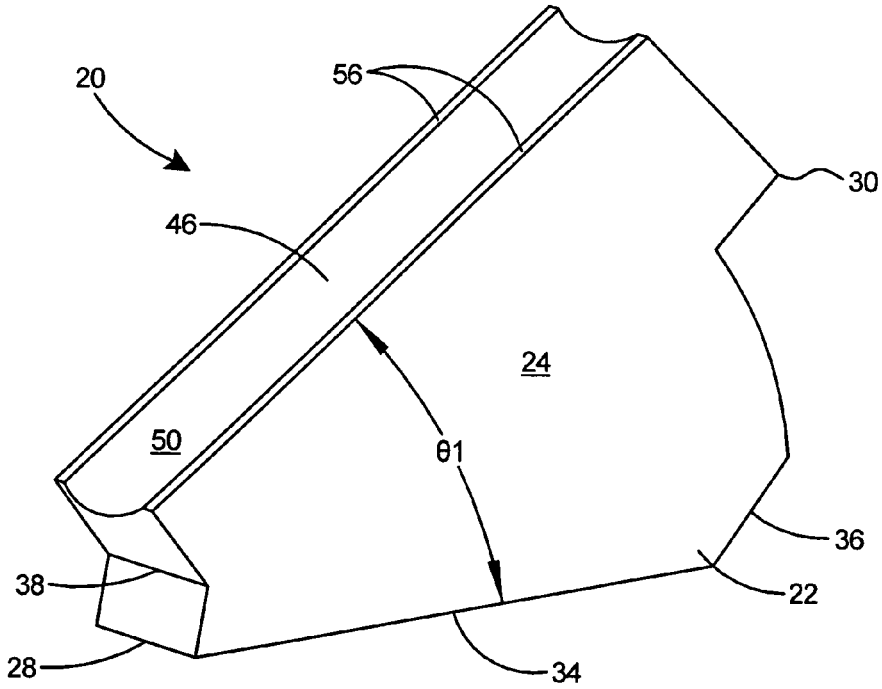
FIG. 8 is a perspective view of the arm elevation device as viewed from the left side of FIG. 1.

The flexible cover 54 is preferably constructed of either fabric or plastic. Most preferably, the flexible cover 54 is constructed of fabric and the preferred fabric is cotton. As shown in FIG. 9, the first base 34 preferably includes a length L1 of at least 15 inches. As shown in FIG. 10, the second base 36 preferably includes a length L2 of at least 5 inches. Preferably, as shown in FIG. 8, top 32 of the arm support body 22 and thus the arcuate arm rest surface 50 of the channel 46 is at a constant slope or angle Θ1 of between 30 and 50 degrees with respect to the first base 34.

As the invention has been described, it will be apparent to those skilled in the art that the same may be varied in many ways without departing from the spirit and scope of the invention. Any and all such modifications are intended to be included within the scope of the appended claims.

What is claimed is:

1. An arm elevation device for a lymphedema patient to keep an arm elevated with respect to a heart of the patient while sitting or lying down comprising:

an arm support body including two sides, a bottom, a first end and a second end;

a top inclining at a constant slope from said first end to said second end;

said bottom including a first base and a second base;

said first base including a flat surface and said second base including a flat surface;

an axially aligned longitudinal channel in top of said arm support body, said channel including an arcuate arm rest surface;

a V-shaped shoulder support notch extending laterally across said first end of said arm support body, said arm elevation device including said shoulder support notch maintaining the arm of the lymphedema patient at a level above the heart thereby assisting in gravity flow of a lymph fluid back to a blood recirculation system;

said arm support body includes a core member and a removable flexible cover;

said core member is constructed of polyurethane foam having a density of 0.90 to 1.10 pounds per cubic foot; and said flexible cover includes a closure device at said bottom of said arm support body.

2. The arm elevation device of claim 1 wherein said first base and said second base include flat surfaces.

3. The arm elevation device of claim 1 wherein said arm support body includes a weight; and a handle on said first base, said handle positioned on said first base such that the weight of said arm support body is balanced when said arm support body is lifted by said handle.

4. The arm elevation device of claim 1 including a head portion extending from said second end adjacent said top of said arm support body.

5. The arm elevation device of claim 1 including a linear channel rim on each side of said axially aligned longitudinal channel.

6. The arm elevation device of claim 5 wherein said arcuate arm rest surface includes a middle; and said channel includes a depth of at least one inch from the middle of said arcuate arm rest surface to said channel rims.

7. The arm elevation device of claim 1 wherein said polyurethane foam includes an indentation force deflection at 25% deflection of from 27 to 33 pounds measured according to ASTM 3574.

8. The arm elevation device of claim 1 wherein the material of construction of said flexible cover is selected from the group including fabric and plastic.

9. The arm elevation device of claim 1 where the material of construction of said flexible cover is cotton fabric.

10. The arm elevation device of claim 1 wherein said closure device is a zipper.

11. The arm elevation device of claim 1 wherein said closure device is a hook and loop fastener.

12. The arm elevation device of claim 1 wherein said flexible cover includes a flap there over said closure device.

13. The arm elevation device of claim 1 wherein said first base includes a length of at least 15 inches.

14. The arm elevation device of claim 1 wherein said second base includes a length of at least 5 inches.

15. The arm elevation device of claim 1 wherein said constant slope of said top of said arm support body is between 30 and 50 degrees with respect to said first base.

* * * * *